US010472739B2

(12) United States Patent
Yano et al.

(10) Patent No.: US 10,472,739 B2
(45) Date of Patent: Nov. 12, 2019

(54) YARN MANUFACTURING DEVICE

(71) Applicant: Murata Machinery, Ltd., Kyoto-shi, Kyoto (JP)

(72) Inventors: Fumiaki Yano, Kyoto (JP); Shuichi Fukuhara, Kyoto (JP); Hiroki Takashima, Kyoto (JP)

(73) Assignee: Murata Machinery Ltd., Kyoto (JP)

( * ) Notice: Subject to any disclaimer, the term of this patent is extended or adjusted under 35 U.S.C. 154(b) by 488 days.

(21) Appl. No.: 14/906,520

(22) PCT Filed: Jul. 22, 2013

(86) PCT No.: PCT/JP2013/069816

§ 371 (c)(1),
(2) Date: Jan. 20, 2016

(87) PCT Pub. No.: WO2015/011771

PCT Pub. Date: Jan. 29, 2015

(65) Prior Publication Data

US 2016/0160398 A1 Jun. 9, 2016

(51) Int. Cl.
*D01H 1/11* (2006.01)
*D01H 1/115* (2006.01)
(Continued)

(52) U.S. Cl.
CPC ..... *D01H 1/115* (2013.01); *D01H 1/14* (2013.01); *D01H 5/005* (2013.01); *D02G 3/16* (2013.01); *D02J 11/00* (2013.01)

(58) Field of Classification Search
CPC ..... D01H 9/00; D01H 9/005; D01H 9/02; D01H 9/18; D01H 1/15; D01G 31/00;
(Continued)

(56) References Cited

U.S. PATENT DOCUMENTS 3,709,610 A 1/1973 Kruegle
4,041,686 A * 8/1977 Inaba ..... B65H 67/064 242/473.5

(Continued)

FOREIGN PATENT DOCUMENTS

CN 102953171 A 3/2013
EP 1316631 A1 6/2003

(Continued)

OTHER PUBLICATIONS

Office Action dated Sep. 22, 2016 issued in corresponding Korean Patent Application No. 10-2015-7036074 cites the United States patent document and Japanese patent documents above.

(Continued)

*Primary Examiner* — Shaun R Hurley
*Assistant Examiner* — Bao-Thieu L Nguyen
(74) *Attorney, Agent, or Firm* — DLA Piper LLP (US)

(57) ABSTRACT

A yarn producing apparatus for producing carbon nanotube (CNT) yarn by aggregating CNT fibers. A front roller continuously draws the CNT fibers from at least one CNT forming substrate, a yarn producing unit aggregates the CNT fibers drawn by the front roller, and a status monitors a state of the CNT fibers drawn from the CNT forming substrate, or the CNT yarn.

15 Claims, 4 Drawing Sheets

(51) Int. Cl.

| | |
|---|---|
| ***D02G 3/16*** | (2006.01) |
| ***D01H 1/14*** | (2006.01) |
| ***D01H 5/00*** | (2006.01) |
| ***D02J 11/00*** | (2006.01) |

(58) Field of Classification Search
CPC . D01G 23/00; D02G 3/16; D02G 3/02; D10B 2101/122
USPC ..... 57/333, 22
See application file for complete search history.

(56) References Cited

U.S. PATENT DOCUMENTS

| | | | | |
|---|---|---|---|---|
| 4,163,359 | A | 8/1979 | Honjo | |
| 4,642,978 | A | 2/1987 | Noda | |
| 4,817,381 | A * | 4/1989 | Meissner | D01H 13/32 57/261 |
| 5,163,279 | A | 11/1992 | Stahlecker | |
| 5,469,696 | A * | 11/1995 | Gerhard | B65H 63/082 57/264 |
| 5,732,541 | A * | 3/1998 | Kunzelman | D04C 1/12 57/7 |
| 6,324,826 | B1 * | 12/2001 | Schuller | D01H 4/40 57/417 |
| 6,438,934 | B1 * | 8/2002 | Foster | D02G 1/02 57/264 |
| 6,439,096 | B1 * | 8/2002 | Mungalov | D04C 1/06 87/33 |
| 6,655,122 | B2 * | 12/2003 | Shigeyama | D01H 1/115 57/264 |
| 6,792,744 | B2 * | 9/2004 | Feuerlohn | D01H 1/115 57/328 |
| 7,993,620 | B2 | 8/2011 | Lashmore et al. | |
| 2008/0170982 | A1 * | 7/2008 | Zhang | B82Y 10/00 423/447.3 |
| 2008/0276594 | A1 | 11/2008 | Stahlecker et al. | |
| 2014/0217643 | A1 * | 8/2014 | Nikawa | B82Y 30/00 264/299 |
| 2015/0045831 | A1 * | 2/2015 | Allen | A61F 2/0811 606/228 |
| 2015/0147573 | A1 * | 5/2015 | Zhang | B82Y 10/00 428/408 |
| 2015/0240394 | A1 * | 8/2015 | Blankenhorn | D01H 1/115 57/333 |
| 2015/0308018 | A1 * | 10/2015 | Zhang | B82Y 10/00 156/167 |
| 2016/0032499 | A1 * | 2/2016 | Cooper | D02G 3/16 57/59 |
| 2016/0083872 | A1 * | 3/2016 | Zhang | B82Y 10/00 264/164 |
| 2016/0138202 | A1 * | 5/2016 | Takashima | D02G 3/16 57/328 |
| 2016/0153125 | A1 * | 6/2016 | Takashima | D02G 3/16 19/150 |
| 2016/0160398 | A1 * | 6/2016 | Yang | D01H 1/115 57/328 |
| 2016/0160401 | A1 * | 6/2016 | Takashima | D01H 1/115 57/333 |
| 2016/0160402 | A1 * | 6/2016 | Yano | D01H 13/14 425/135 |
| 2016/0201229 | A1 * | 7/2016 | Yano | D01H 1/115 57/333 |
| 2016/0251778 | A1 * | 9/2016 | Zhang | B82Y 10/00 428/408 |
| 2016/0273133 | A1 * | 9/2016 | Zhang | B82Y 10/00 |
| 2016/0312387 | A1 * | 10/2016 | Zhang | B82Y 10/00 |
| 2017/0001866 | A1 * | 1/2017 | Zhang | B82Y 10/00 |
| 2017/0137290 | A1 * | 5/2017 | Zhang | B82Y 10/00 |

FOREIGN PATENT DOCUMENTS

| | | | |
|---|---|---|---|
| EP | 2090538 | A2 | 8/2009 |
| JP | H9-228163 | A | 9/1997 |
| JP | 2010116632 | A | 5/2010 |
| JP | 2011-038203 | A | 2/2011 |
| JP | 4900619 | B2 | 3/2012 |
| JP | 2013011039 | A | 1/2013 |
| WO | 2007119747 | A | 10/2007 |
| WO | 2008022129 | A2 | 2/2008 |

OTHER PUBLICATIONS

Supplementary Partial European Search Report dated Feb. 16, 2017 issued in corresponding European Patent Application No. 13890158.2 (EP 13 89 0158) cites the documents above.

Office Action dated Aug. 19, 2016 issued in corresponding Chinese Patent Application No. 201380077861.3 cites the United States patent documents and European patent document above.

Notification of Transmittal of Translation of the International Preliminary Report on Patentability (Form PCT/IB/338) dated Feb. 4, 2016 for Counterpart PCT Application PCT/JP2013/069816.

International Preliminary Report on Patentability (Form PCT/IB/373) dated Jan. 26, 2016 for Counterpart PCT Application PCT/JP2013/069816.

Written Opinion of the International Searching Authority (Form PCT/ISA/237) dated Oct. 8, 2013 for Counterpart PCT Application PCT/JP2013/069816.

Extended European Search Report dated May 11, 2017 (May 11, 2017), issued in corresponding European Patent Application No. 13890158.2 (EP 13 89 0158) cite the documents above.

Anonymous, "Evenness", Internet URL:http://nptel.ac.in/courses/116102005/13, Mar. 15, 2012 (Mar. 15, 2012), pp. 12-14,17, XP055320852.

* cited by examiner

YARN MANUFACTURING DEVICE

CROSS REFERENCE TO RELATED APPLICATIONS

This application is a national stage of international application no. PCT/JP2013/069816, filed on Jul. 22, 2013, which is incorporated herein by reference.

TECHNICAL FIELD

The present invention relates to a yarn producing apparatus for producing carbon nanotube yarn from carbon nanotube fibers.

BACKGROUND ART

An example of the yarn producing apparatus as described above includes a drawing unit that continuously draws carbon nanotube fibers from a carbon nanotube forming substrate and a yarn producing unit that twists the carbon nanotube fibers drawn by the drawing unit to produce yarn (for example, see Patent Literature 1).

CITATION LIST

Patent Literature

[Patent Literature 1] Japanese Patent Application Laid-Open Publication No. 2010-116632

SUMMARY OF INVENTION

Technical Problem

It is known that the performance of drawing carbon nanotube fibers varies with, for example, the speed of drawing carbon nanotube fibers from the carbon nanotube forming substrate. In the field of such yarn producing apparatus, therefore, it is requested to monitor the state of carbon nanotube yarn.

It is therefore an object of the present invention to provide a yarn producing apparatus capable of monitoring the production state of carbon nanotube yarn.

Solution to Problem

A yarn producing apparatus according to an aspect of the present invention produces carbon nanotube yarn by twisting or false-twisting carbon nanotube fibers. The yarn producing apparatus includes a drawing unit, a yarn producing unit, and a status monitor. The drawing unit continuously draws the carbon nanotube fibers from at least one carbon nanotube forming substrate. The yarn producing unit aggregates the carbon nanotube fibers drawn by the drawing unit. The status monitor monitors a state of the carbon nanotube fibers drawn from the carbon nanotube forming substrate, or the carbon nanotube yarn.

In this yarn producing apparatus, the status monitor monitors the state of the carbon nanotube fibers or the carbon nanotube yarn to monitor the production state of the carbon nanotube yarn. Monitoring the production state of the carbon nanotube yarn as described above enables, for example, an appropriate response to the problem detected by the status monitor.

The status monitor may be a yarn thickness detecting sensor configured to detect the thickness of the carbon nanotube yarn. In this case, since the thickness of the carbon nanotube yarn can be detected, production of carbon nanotube yarn having a problem in thickness can be prevented. The yarn thickness detecting sensor may detect the thickness of the carbon nanotube yarn based on the amount of fibers of the carbon nanotube fibers drawn from the carbon nanotube forming substrate or may directly detect the thickness of the carbon nanotube yarn.

The yarn producing apparatus may further include a controller configured to control the amount of the carbon nanotube fibers drawn by the drawing unit, in accordance with a monitoring result in the status monitor. In this case, the monitoring result from the status monitor can be fed back to the amount of drawn carbon nanotube fibers. Controlling the amount of drawn carbon nanotube fibers based on the monitoring result enables production of carbon nanotube yarn of a uniform thickness.

The controller may control the amount of drawn carbon nanotube fibers by changing the speed of drawing the carbon nanotube fibers in the drawing unit. In this case, the amount of carbon nanotube fibers can be easily controlled merely by changing the speed of drawing the carbon nanotube fibers.

The yarn producing apparatus may further include a drawing count changing unit configured to change the number of carbon nanotube forming substrates from which the carbon nanotube fibers are drawn, from the plurality of carbon nanotube forming substrates. The controller may control the drawing count changing unit to change the number of carbon nanotube forming substrates from which the carbon nanotube fibers are drawn, thereby controlling the amount of drawn carbon nanotube fibers. In this case, the amount of carbon nanotube fibers can be easily controlled merely by changing the number of carbon nanotube forming substrates from which the carbon nanotube fibers are drawn.

When running of the carbon nanotube fibers or the carbon nanotube yarn is not detected by the status monitor, the controller may stop the operation of the drawing unit and the operation of the yarn producing unit. This configuration prevents the continued operation of the drawing unit and the yarn producing unit in spite of the carbon nanotube fibers or the carbon nanotube yarn not running and enables appropriate control of the yarn producing apparatus.

When the carbon nanotube yarn of a desired thickness is not produced after the amount of the carbon nanotube fibers drawn by the drawing unit is controlled, the controller may stop the operation of the drawing unit and the yarn producing unit. This configuration can prevent the continued production of carbon nanotube yarn in spite of the failure in producing the carbon nanotube yarn of a desired thickness.

The yarn producing unit may false-twist the carbon nanotube fibers with airflow. The use of airflow enables fast false-twisting of the carbon nanotube fibers. In this case, it is necessary to draw the carbon nanotube fibers at high speed from the carbon nanotube forming substrate. Increasing the speed of drawing, however, tends to lead to a failure in drawing a desired amount of carbon nanotube fibers. The yarn producing apparatus that false-twists the carbon nanotube fibers with airflow is provided with a status monitor to monitor the state of the carbon nanotube yarn. This configuration enables, for example, a more appropriate response to the problem detected by the status monitor.

The yarn producing apparatus may further include a substrate support unit supporting the carbon nanotube forming substrate. This configuration enables stable supply of the carbon nanotube fibers.

Advantageous Effects of Invention

The present invention enables monitoring of the production state of carbon nanotube yarn.

DESCRIPTION OF EMBODIMENTS

An embodiment of the present invention will be described in details below with reference to the drawings. It should be noted that the same or corresponding elements are denoted with the same reference signs in the description of the drawings and an overlapping description will be omitted.

Figure 1:
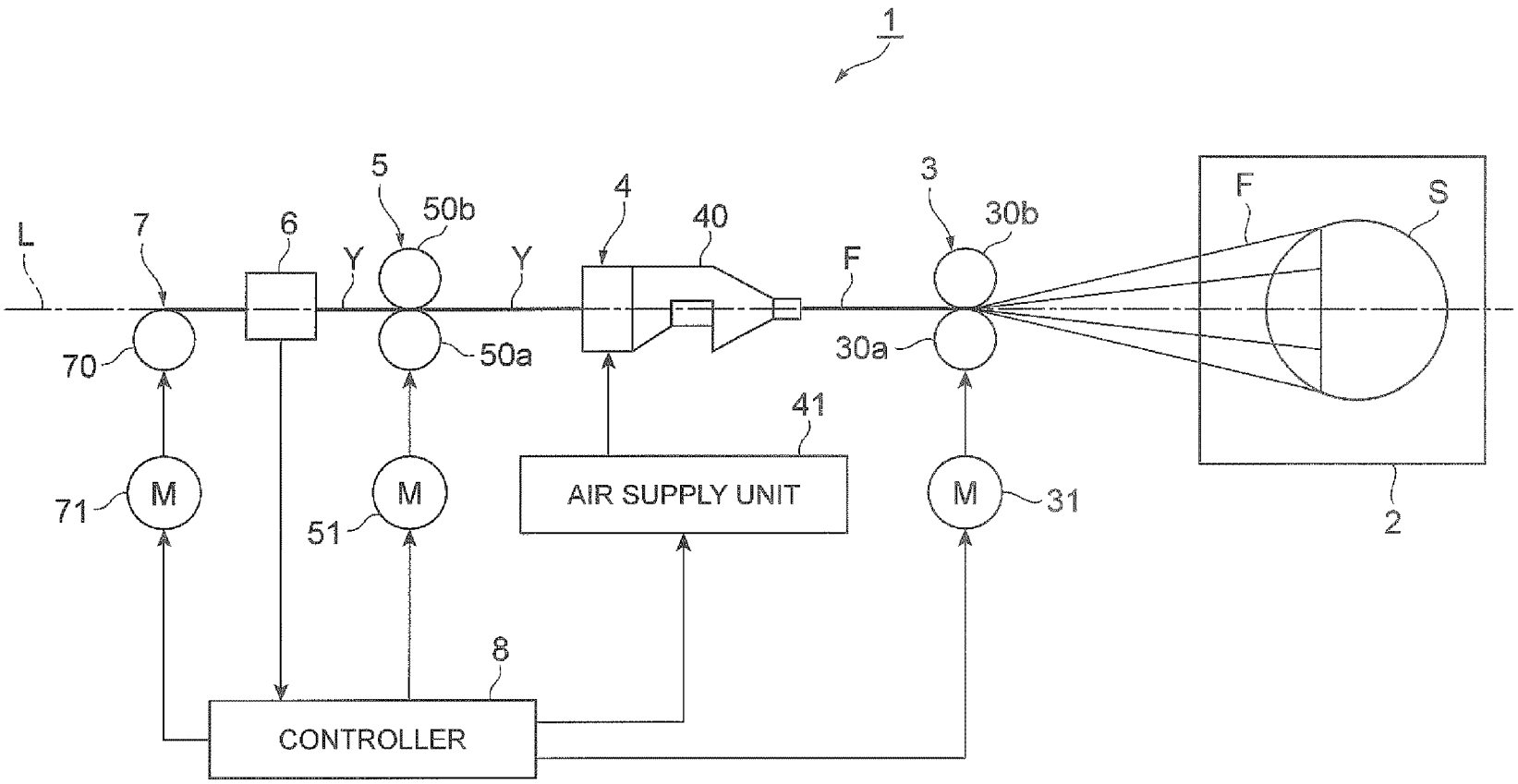
FIG. 1 is a plan view schematically illustrating the configuration of a yarn producing apparatus according to an embodiment.

As shown in FIG. 1, a yarn producing apparatus 1 is an apparatus that produces carbon nanotube yarn (hereinafter referred to as "CNT yarn") Y from carbon nanotube fibers (hereinafter referred to as "CNT fibers") F while allowing the CNT fibers F to run. The yarn producing apparatus 1 is configured to include a substrate support unit 2, a front roller unit (drawing unit) 3, a yarn producing unit 4, a nip roller unit 5, a yarn thickness detecting sensor (status monitor) 6, a winding unit 7, and a controller 8. The substrate support unit 2, the front roller unit 3, the yarn producing unit 4, the nip roller unit 5, the yarn thickness detecting sensor 6, and the winding unit 7 are arranged in this order on a predetermined line L. The CNT fibers F and the CNT yarn Y run from the substrate support unit 2 toward the winding unit 7. The CNT fibers F are a set of a plurality of fibers of carbon nanotube. The CNT yarn Y is CNT fibers F twisted (false-twisted) by the yarn producing unit 4.

The substrate support unit 2 supports a carbon nanotube forming substrate (hereinafter referred to as "CNT forming substrate") S from which the CNT fibers F are drawn, in a state of holding the CNT forming substrate S. The CNT forming substrate S is called a carbon nanotube forest or a vertically aligned carbon nanotube structure in which high-density and highly-oriented carbon nanotubes (for example, single-wall carbon nanotubes, double-wall carbon nanotubes, or multi-wall carbon nanotubes) are formed on a substrate by chemical vapor deposition or any other process. Examples of the substrate include a plastic substrate, a glass substrate, a silicon substrate, and a metal substrate. At the start of production of CNT yarn Y or during replacement of CNT forming substrates 5, for example, a tool called a microdrill can be used to draw CNT fibers F from the CNT forming substrate S.

The front roller unit 3 includes a driving roller 30*a*, a driven roller 30*b*, and a driving motor 31. The respective outer circumferential surfaces of the driving roller 30*a* and the driven roller 30*b* abut on each other. The driving roller 30*a* is rotated by the driving force from the driving motor 31. The driven roller 30*b* is driven to rotate with the rotation of the driving roller 30*a*. The CNT fibers F drawn from the CNT forming substrate S are sandwiched between the driving roller 30*a* and the driven roller 30*b*. The CNT fibers F are continuously drawn from the CNT forming substrate S with the rotation of the driving roller 30*a* and the driven roller 30*b* and are aggregated into yarn.

The yarn producing unit 4 twists the CNT fibers F drawn from the CNT forming substrate S by the front roller unit 3. The yarn producing unit 4 includes a nozzle 40 and an air supply unit 41. The air supply unit 41 supplies air to the nozzle 40. The nozzle 40 blows the air supplied from the air supply unit 41 around the CNT fibers F to twist (false-twist) the CNT fibers F with the airflow to generate CNT yarn Y.

The nip roller unit 5 includes a driving roller 50*a*, a driven roller 50*b*, and a driving motor 51. The respective outer circumferential surfaces of the driving roller 50*a* and the driven roller 50*b* abut on each other. The driving roller 50*a* is rotated by the driving force from the driving motor 51. The driven roller 50*b* is driven to rotate with the rotation of the driving roller 50*a*. The CNT yarn Y twisted by the yarn producing unit 4 is sandwiched between the driving roller 30*a* and the driven roller 30*b*. Although the CNT yarn Y flaps immediately after being output from the yarn producing unit 4, the driving roller 50*a* and the driven roller 50*b* sandwich the CNT yarn Y to eliminate or minimize the flap.

The yarn thickness detecting sensor 6 monitors the state of the CNT yarn Y, here, detects the thickness of the CNT yarn Y. Examples of the yarn thickness detecting sensor 6 include optical, contact, and capacitive sensors. Any sensor can be used as long as it can detect the thickness of the CNT yarn Y. The result of detection by the yarn thickness detecting sensor 6 is output to the controller 8.

The winding unit 7 includes a winding tube 70 and a driving motor 71. The CNT yarn Y is wound onto the winding tube 70. The driving motor 71 drives the rotation of the winding tube 70 to wind the CNT yarn Y onto the winding tube 70.

The controller 8 controls the rotational speeds of the driving motors 31, 51, and 71 and controls the amount of air supply to the nozzle 40 in the air supply unit 41, based on the detection result from the yarn thickness detecting sensor 6. More specifically, if the yarn thickness detecting sensor 6 detects that the thickness of the CNT yarn Y is smaller than the lower limit in a predetermined range, the controller 8 decreases the rotational speeds of the driving motors 31, 51, and 71 and reduces the amount of air supplied from the air supply unit 41 to the nozzle 40 thereby reducing the speed of drawing CNT fibers F from the CNT forming substrate S. Reducing the speed of drawing CNT fibers F from the CNT forming substrate S improves the performance of drawing CNT fibers F and increases the amount of CNT fibers F per unit length of the drawn CNT fibers F. The thickness of the CNT yarn Y thus can be increased.

If the yarn thickness detecting sensor 6 detects that the thickness of the CNT yarn Y is larger than the upper limit in a predetermined range, the controller 8 increases the rotational speeds of the driving motors 31, 51, and 71 and increases the amount of air supplied from the air supply unit 41 to the nozzle 40 thereby to increase the speed of drawing CNT fibers F from the CNT forming substrate S. Increasing the speed of drawing CNT fibers F from the CNT forming substrate S reduces the performance of drawing CNT fibers F and reduces the amount of CNT fibers F per unit length of the drawn CNT fibers F. The thickness of the CNT yarn Y thus can be reduced.

As described above, the controller 8 can control the thickness of the CNT yarn Y by controlling the rotational speeds of the driving motors 31, 51, and 71 and controlling the amount of air supply to the nozzle 40 in the air supply unit 41.

After the controller 8 controls the driving motor 31 and other motors, and the air supply unit 41 to control the amount of CNT fibers F drawn from the CNT forming substrate S, if a desired yarn thickness (a yarn thickness in a predetermined range) is not detected by the yarn thickness detecting sensor 6, the controller 8 stops the rotation of the driving motors 31, 51, and 71 and stops the air supply to the nozzle 40 in the air supply unit 41.

If the yarn thickness detecting sensor 6 does not detect the thickness of the CNT yarn Y, that is, if it does not detect the running of the CNT yarn Y due to yarn breakage or other reasons, the controller 8 stops the rotation of the driving motors 31, 51, and 71 and stops the air supply to the nozzle 40 in the air supply unit 41.

Figure 2:
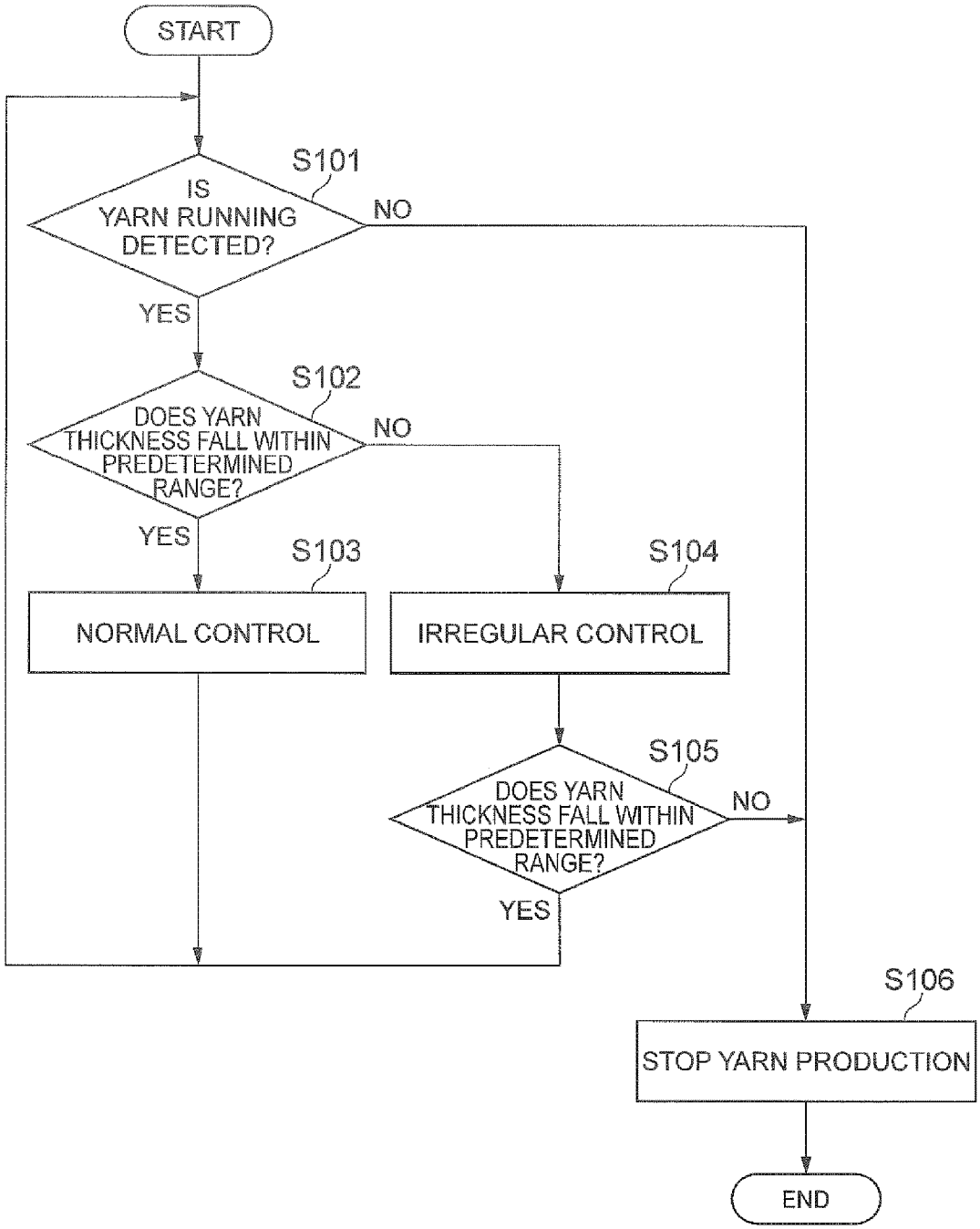
FIG. 2 is a flowchart illustrating the procedure of processing performed by the controller in FIG. 1.

The procedure of processing performed in the controller 8 will now be described. As shown in FIG. 2, the controller 8 determines whether the CNT yarn Y runs based on the detection result from the yarn thickness detecting sensor 6 (step S101). If the CNT yarn Y is running (step S101: YES), the controller 8 determines whether the thickness of the CNT yarn Y falls within a predetermined range, based on the detection result from the yarn thickness detecting sensor 6 (step S102). If the thickness of the CNT yarn Y falls within a predetermined range (step S102: YES), the controller 8 performs normal control on the driving motor 31 and other motors, and the air supply unit 41 (step S103). The normal control refers to the control of the driving motor 31 and other motors, and the air supply unit 41, for example, with predetermined control values or the control values for the driving motor 31 and other motors, and the air supply unit 41 in the present state in which the thickness of the CNT yarn Y falls within a predetermined range. After the normal control, the controller 8 performs the processing in step S101.

If the thickness of the CNT yarn Y does not fall within a predetermined range (step S102: NO), the controller 8 performs irregular control on the driving motor 31 and other motors, and the air supply unit 41 (step S104). The irregular control refers to control that brings the thickness of the CNT yarn Y into a predetermined range by controlling the rotational speeds of the driving motor 31 and other motors, and the amount of air supply to the nozzle 40, as described above.

After the irregular control, the controller 8 determines whether the thickness of the CNT yarn Y falls within a predetermined range, based on the detection result from the yarn thickness detecting sensor 6 (step S105). This processing is to determine whether the thickness of the CNT yarn Y falls within a predetermined range as a result of performing the irregular control. If the thickness of the CNT yarn Y falls within a predetermined range (step S105: YES), the controller 8 performs the processing in step S101.

If the CNT yarn Y is not running (step S101: NO), or if the thickness of the CNT yarn Y does not fall within a predetermined range after the irregular control (step S105: NO), the controller 8 stops the rotation of the driving motors 31, 51, and 71 and stops the air supply to the nozzle 40 in the air supply unit 41 (step S106).

The present embodiment is configured as described above. In the yarn producing apparatus 1, the yarn thickness detecting sensor 6 can be used to monitor the production state of CNT yarn Y. Monitoring the production state of CNT yarn Y enables, for example, an appropriate response to the problem detected by the yarn thickness detecting sensor 6.

The use of the yarn thickness detecting sensor 6, which detects the thickness of the CNT yarn Y, can prevent production of CNT yarn Y having a problem in thickness.

The controller 8 is provided, which performs control on the driving motor 31 and other units based on the detection result from the yarn thickness detecting sensor 6. With this configuration, the result of detection by the yarn thickness detecting sensor 6 can be fed back to the amount of drawn CNT fibers F. CNT yarn Y of a uniform thickness can be produced by controlling the amount of drawn CNT fibers F based on the detection result from the yarn thickness detecting sensor 6.

If the yarn thickness detecting sensor 6 does not detect the running of CNT yarn Y, the controller 8 stops the operation of the driving motor 31 and other units. This processing prevents the continued operation of the front roller unit 3, the yarn producing unit 4, and other units in spite of the CNT yarn Y not running and enables appropriate control of the yarn producing apparatus 1.

After the controller 8 controls the driving motor 31 and other units to control the amount of CNT fibers F drawn from the CNT forming substrate S, if CNT yarn Y of a desired thickness is not produced, the controller 8 stops the operation of the driving motor 31 and other units. This processing can prevent the continued production of CNT yarn Y in spite of the failure in producing CNT yarn Y of a desired thickness.

The yarn producing unit 4 includes the nozzle 40, which twists the CNT fibers F with airflow. The use of airflow enables fast twisting of the CNT fibers F. In this case, it is necessary to draw CNT fibers F at high speed from the CNT forming substrate S. Increasing the speed of drawing, however, tends to lead to a failure in drawing the desired amount of CNT fibers F. The yarn producing apparatus 1 that twists the CNT fibers F with airflow is therefore provided with the yarn thickness detecting sensor 6 to monitor the state of CNT yarn Y. The monitoring enables, for example, a more appropriate response to the problem detected by the yarn thickness detecting sensor 6.

The provision of the substrate support unit 2 supporting the CNT forming substrate S enables stable supply of CNT fibers F.

Figure 3:
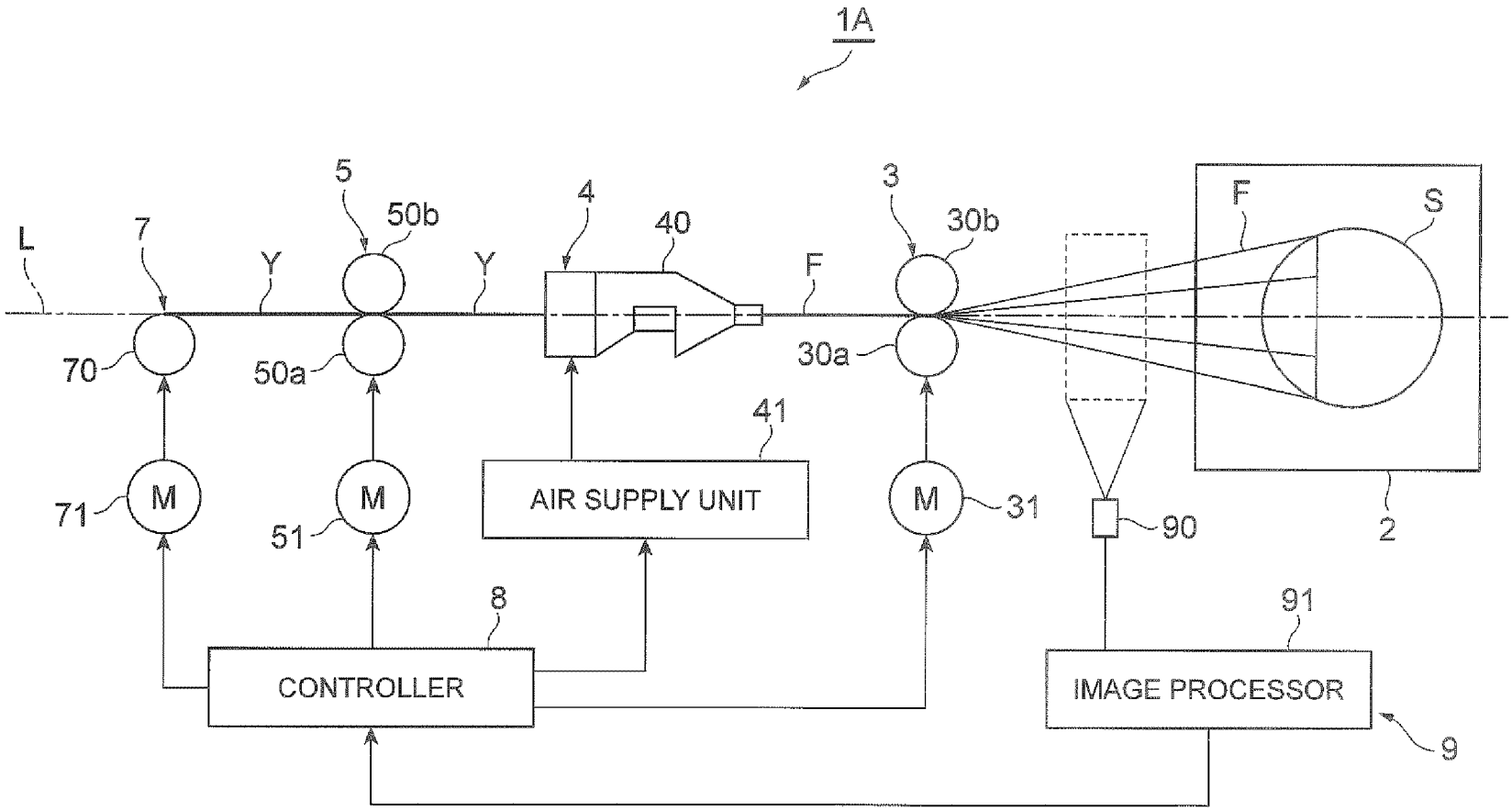
FIG. 3 is a plan view schematically illustrating the configuration of a yarn producing apparatus according to a first modification.

A first modification will now be described. In the foregoing embodiment, the thickness of the CNT yarn Y is detected using the yarn thickness detecting sensor 6. However, in place of the yarn thickness detecting sensor 6, the CNT fibers F drawn from the CNT forming substrate S may be monitored. A yarn producing apparatus according to the first modification that monitors the CNT fibers F to control the driving motor 31 and other units will be described below. As shown in FIG. 3, a yarn producing apparatus 1A according to the present modification includes a fibers detector (status monitor) 9 in place of the yarn thickness detecting sensor 6 in the yarn producing apparatus 1 in the foregoing embodiment. The other components in the yarn producing apparatus 1A are the same as those in the yarn producing apparatus 1 in the embodiment and are denoted with the same reference signs, and a detailed description thereof will be omitted.

The fibers detector 9 includes a camera 90 and an image processor 91. The camera 90 captures an image of the CNT fibers F drawn from the CNT forming substrate S and not yet reaching the front roller unit 3. The image processor 91 calculates the amount of CNT fibers F based on the image captured by the camera 90. In this calculation, for example, known image processing techniques can be used. The amount of CNT fibers F drawn from the CNT forming substrate S can be calculated from the proportion of the CNT fibers F in the imaging range, based on the image captured by the camera 90. If the amount of CNT fibers F is large, the thickness of the CNT yarn Y increases. If the amount of CNT fibers F is small, the thickness of the CNT yarn Y decreases. Based on this, the thickness of the CNT yarn Y can be estimated from the amount of CNT fibers F drawn from the CNT forming substrate S. The image processor 91 estimates the thickness of the CNT yarn Y based on the calculated amount of CNT fibers F and outputs the estimated thickness to the controller 8.

The image processor 91 can detect the state in which CNT fibers F are not drawn from the CNT forming substrate S, that is, the state in which the CNT yarn Y is not running, based on the image captured by the camera 90.

The controller 8 controls the driving motor 31 and other units based on the thickness of the CNT yarn Y, in the same manner as in the foregoing embodiment. The present modification therefore can achieve the same effects as in the embodiment.

Figure 4:
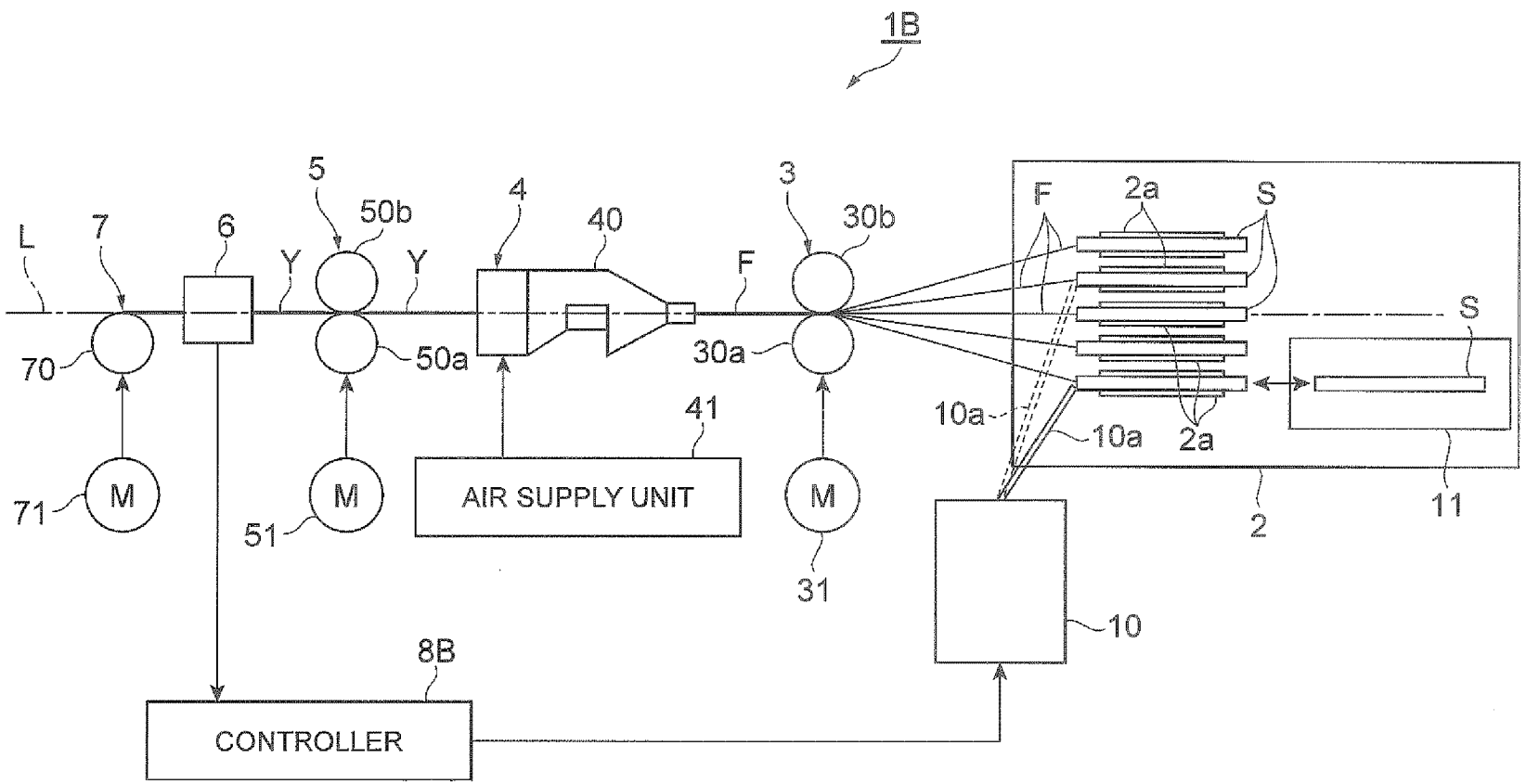
FIG. 4 is a plan view schematically illustrating the configuration of a yarn producing apparatus according to a second modification.

A second modification will now be described. In the second modification, the substrate support unit 2 can support a plurality of CNT forming substrates S, and the number of CNT forming substrates S from which CNT fibers F are drawn is changed. As shown in FIG. 4, a yarn producing apparatus 1B according to the present modification differs from the yarn producing apparatus 1 in the foregoing embodiment in that the controller 8 is replaced by a controller 8B and that a drawing count changing unit 10 and a substrate replacing unit 11 are added. The other components in the yarn producing apparatus 1B are the same as those in the yarn producing apparatus 1 according to the embodiment and are denoted with the same reference signs, and a detailed description thereof will be omitted.

The substrate support unit 2 includes a plurality of substrate supports 2*a*. Each substrate support 2*a* supports a CNT forming substrate S. Each substrate support 2*a* supports a CNT forming substrate S such that the CNT forming substrate S stands on the surface of the substrate support unit 2. The drawing count changing unit 10 changes the number of CNT forming substrates S from which CNT fibers F are drawn, among a plurality of CNT forming substrates S supported on the substrate supports 2*a*. Specifically, in order to add a new CNT forming substrate S from which CNT fibers F are drawn, the drawing count changing unit 10 extends a drawing nozzle 10*a* to the CNT forming substrate S of interest and draws CNT fibers F from the CNT forming substrate S by the suction force of the drawing nozzle 10*a*. The drawing count changing unit 10 brings the drawn CNT fibers F into contact with the CNT fibers F drawn from other CNT forming substrates S. The newly drawn CNT fibers F are then sent together with the CNT fibers F drawn from other CNT forming substrates S to the yarn producing unit 4.

The substrate replacing unit 11 replaces, among the CNT forming substrates S supported on the substrate support unit 2, the CNT forming substrate S running out of carbon nanotube fibers with a new CNT forming substrate S.

The controller 8B controls the drawing count changing unit 10, based on the result of detection of the thickness of CNT yarn Y by the yarn thickness detecting sensor 6, to change the number of CNT forming substrates S from which CNT fibers F are drawn. Specifically, if the yarn thickness detecting sensor 6 detects that the thickness of the CNT yarn Y decreases, the controller 8B controls the drawing count changing unit 10 to increase the number of CNT forming substrates S from which CNT fibers F are drawn.

If the yarn thickness detecting sensor 6 detects that the thickness of the CNT yarn Y increases, the controller 8B controls the substrate support 2*a* supporting the CNT forming substrate S such that the CNT forming substrate S is inclined relative to the direction of drawing the CNT fibers F. This control stops the drawing of CNT fibers F and reduces the number of CNT forming substrates S from which CNT fibers F are drawn. The drawing of CNT fibers F may be stopped by any other method. For example, the drawing may be stopped by cutting means for cutting the CNT fibers F drawn from the CNT forming substrate S.

As described above, the controller 8B controls the drawing count changing unit 10 and the substrate supports 2*a* based on the detection result of the yarn thickness detecting sensor 6. This configuration enables control of the amount of drawn CNT fibers F and production of CNT yarn Y of a uniform thickness.

Although an embodiment and modifications of the present invention have been described above, the present invention is not intended to be limited to the foregoing embodiment. For example, in the foregoing embodiment, the controller 8 controls the driving motor 31 and other units based on the thickness of the CNT yarn Y detected by the yarn thickness detecting sensor 6. In this case, the thickness of the yarn detected by the yarn thickness detecting sensor 6 can be recorded together with the position of the CNT yarn Y by a recorder. With this configuration, the position of the section having a thickness falling outside a predetermined range can be known in the produced CNT yarn Y.

In addition to detecting the thickness of the CNT yarn Y and whether the CNT yarn Y is running using the yarn thickness detecting sensor 6 or the fibers detector 9, for example, any other detector may be used to detect the running speed of the CNT yarn Y or detect the length of the produced CNT yarn Y.

In place of the CNT forming substrate S, for example, a device that continuously synthesizes carbon nanotubes to supply CNT fibers F may be used as the supply source of CNT fibers F. In the embodiment, the yarn producing unit 4 twists CNT fibers F with airflow. However, the yarn producing unit may twist CNT fibers F by any method other than using airflow. The yarn producing unit 4 and the winding unit 7 may be replaced by, for example, a device that winds CNT yarn Y while twisting (genuine-twisting) CNT fibers F to produce CNT yarn Y.

INDUSTRIAL APPLICABILITY

The present invention can provide a yarn producing apparatus capable of monitoring the production state of carbon nanotube yarn.

REFERENCE SIGNS LIST

1, 1A . . . yarn producing apparatus, 2 . . . substrate support unit, 3 . . . front roller unit (drawing unit), 4 . . . yarn producing unit, 5 . . . nip roller unit, 6 . . . yarn thickness detecting sensor (status monitor), 7 . . . winding unit, 8 . . . controller, 9 . . . fibers detector (status monitor), 10 . . . drawing count changing unit, F . . . CNT fibers, S . . . CNT forming substrate, Y . . . CNT yarn.

The invention claimed is:

1. A yarn producing apparatus that produces carbon nanotube yarn by aggregating carbon nanotube fibers, the yarn producing apparatus comprising:

a drawing unit configured to continuously draw the carbon nanotube fibers from at least one carbon nanotube forming substrate, a yarn producing unit including a nozzle and an air supply arranged downstream of the drawing unit and configured to aggregate the carbon nanotube fibers drawn by the drawing unit by twisting or false twisting, a yarn status sensor that monitors characteristics of the carbon nanotube fibers drawn from the carbon nanotube forming substrate, or the carbon nanotube yarn, wherein the yarn status sensor is a yarn thickness detecting sensor configured to detect a thickness of a carbon nanotube yarn, and the yarn producing apparatus includes a controller configured to control an amount of the carbon nanotube fibers drawn by the drawing unit in accordance with a monitoring result in the yarn status sensor, wherein the controller controls the amount of carbon nanotube fibers drawn by the drawing unit by changing a speed of drawing the carbon nanotube fibers in the drawing unit, and controlling an amount of air supply to the nozzle in the air supply unit.

2. The yarn producing apparatus according to claim 1, wherein the yarn producing apparatus further includes a drawing count changing unit configured to change a number of carbon nanotube forming substrates from which the carbon nanotube fibers are drawn, from the plurality of carbon nanotube forming substrates, and the controller controls the drawing count changing unit to change the number of carbon nanotube forming substrates from which the carbon nanotube fibers are drawn, thereby controlling the amount of drawn carbon nanotube fibers.

3. The yarn producing apparatus according to claim 1, wherein, when running of the carbon nanotube fibers or the carbon nanotube yarn is not detected by the yarn status sensor, the controller stops operation of the drawing unit and operation of the yarn aggregation device.

4. The yarn producing apparatus according to claim 3, wherein, when the carbon nanotube yarn of a predetermined thickness is not produced after the amount of the carbon nanotube fibers drawn by the drawing unit is controlled, the controller is configured to stop operation of the drawing unit and the yarn aggregation device.

5. The yarn producing apparatus according to claim 4, wherein the yarn aggregation device is configured to twist the carbon nanotube fibers with airflow.

6. The yarn producing apparatus according to claim 5, further comprising a substrate support unit supporting the carbon nanotube forming substrate.

7. The yarn producing apparatus according to claim 6, wherein, when running of the carbon nanotube fibers or the carbon nanotube yarn is not detected by the yarn status sensor, the controller stops operation of the drawing rollers and operation of the yarn aggregation device.

8. The yarn producing apparatus according to claim 7, wherein, when the carbon nanotube yarn of a selected thickness is not produced after the amount of the carbon nanotube fibers drawn by the drawing unit is controlled, the controller is configured to stop operation of the drawing unit and the yarn aggregation device.

9. The yarn producing apparatus according to claim 1, wherein, when running of the carbon nanotube fibers or the carbon nanotube yarn is not detected by the yarn status sensor, the controller stops operation of the drawing unit and operation of the yarn aggregation device.

10. The yarn producing apparatus according to claim 9, wherein, when the carbon nanotube yarn of a selected thickness is not produced after the amount of the carbon nanotube fibers drawn by the drawing unit is controlled, the controller is configured to stop operation of the drawing unit and the yarn aggregation device.

11. The yarn producing apparatus according to claim 1, further comprising a drawing count changing unit configured to change a number of carbon nanotube forming substrates from which the carbon nanotube fibers are drawn, from the plurality of carbon nanotube forming substrates, and the controller controls the drawing count changing unit to change the number of carbon nanotube forming substrates from which the carbon nanotube fibers are drawn, thereby controlling the amount of drawn carbon nanotube fibers.

12. The yarn producing apparatus according to claim 11, wherein, when running of the carbon nanotube fibers or the carbon nanotube yarn is not detected by the yarn status sensor, the controller stops operation of the drawing unit and operation of the yarn aggregation device.

13. The yarn producing apparatus according to claim 12, wherein, when the carbon nanotube yarn of a selected thickness is not produced after the amount of the carbon nanotube fibers drawn by the drawing unit is controlled, the controller is configured to stop operation of the drawing unit and the yarn aggregation device.

14. The yarn producing apparatus according to claim 1, wherein the drawing unit comprises drawing rollers.

15. A yarn producing apparatus that produces carbon nanotube yarn by aggregating carbon nanotube fibers, the yarn producing apparatus comprising:

a drawing unit that continuously draws the carbon nanotube fibers from at least one carbon nanotube forming substrate, a yarn producing unit arranged downstream of the drawing unit that aggregates the carbon nanotube fibers drawn by the drawing unit, and a yarn status sensor that monitors selected characteristics of the carbon nanotube fibers drawn from a carbon nanotube forming substrate, or the carbon nanotube yarn, wherein the yarn producing apparatus further includes 1) a controller that controls an amount of the carbon nano tube fibers drawn by the drawing unit in accordance with a monitoring result in the yarn status sensor and 2) a drawing count changing unit configured to change a number of carbon nanotube forming substrates from which the carbon nanotube fibers are drawn, from the plurality of carbon nanotube forming substrates, and the controller controls the drawing count changing unit to change the number of carbon nanotube forming substrates from which the carbon nanotube fibers are drawn, thereby controlling the amount of carbon nanotube fibers drawn by the drawing unit, the controller controls the amount of carbon nanotube fibers drawn by the drawing unit by changing a speed of drawing the carbon nanotube fibers in the drawing unit, and controlling an amount of air supply in an air supply unit to a nozzle in the yarn producing unit.

* * * * *